US006312104B1

(12) United States Patent
Stearns et al.

(10) Patent No.: US 6,312,104 B1
(45) Date of Patent: Nov. 6, 2001

(54) REDUCTION OF SPOT MISPLACEMENT THROUGH ELECTROSTATIC FOCUSING OF UNCHARGED DROPS

(75) Inventors: Richard G. Stearns, Los Gatos; Edward A. Richley, Palo Alto, both of CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/098,763

(22) Filed: Jun. 17, 1998

(51) Int. Cl.[7] ..... B41J 2/135; B41J 2/06
(52) U.S. Cl. ..... 347/46; 347/55
(58) Field of Search ..... 347/46, 55, 53, 347/77, 78; 427/466

(56) References Cited

U.S. PATENT DOCUMENTS

| | | | | |
|---|---|---|---|---|
| 4,338,613 | * | 7/1982 | Cruz-Uribe . | |
| 4,379,301 | | 4/1983 | Fischbeck . | |
| 4,386,358 | | 5/1983 | Fischbeck . | |
| 5,087,931 | | 2/1992 | Rawson . | |
| 5,122,818 | | 6/1992 | Elrod et al. . | |
| 5,191,354 | | 3/1993 | Quate . | |
| 5,392,064 | | 2/1995 | Hadimioglu et al. . | |
| 5,396,273 | * | 3/1995 | Stamer | 347/78 |
| 5,912,679 | * | 6/1999 | Takayama et al. | 347/10 |

FOREIGN PATENT DOCUMENTS

| | | |
|---|---|---|
| 0608879 A | 8/1994 | (EP) . |
| 0704304 A1 | 4/1996 | (EP) . |
| WO 95/32864 | 12/1995 | (GB) . |

* cited by examiner

*Primary Examiner*—John Berlow
*Assistant Examiner*—Michael S. Brooke
(74) *Attorney, Agent, or Firm*—Fay, Sharpe, Fagan, Minnich & McKee, LLP

(57) ABSTRACT

A method and apparatus which laterally focuses aqueous ink drops onto a substrate, using electric fields. The drops are not charged, and focusing results from the forces on the uncharged dielectric drop that occur in a nonuniform electric field. It is shown that initial lateral velocity misdirection of the drops is corrected using electric fields. Lateral velocities which would produce drop displacements of ~50 $\mu$m from their intended positions, at a height of 1 mm above the ink surface, may be corrected to produce displacements of less than 2.5 $\mu$m.

20 Claims, 8 Drawing Sheets

REDUCTION OF SPOT MISPLACEMENT THROUGH ELECTROSTATIC FOCUSING OF UNCHARGED DROPS

BACKGROUND OF THE INVENTION

The present invention is directed to the focusing of ink drops on a spaced apart substrate, and more particularly to lateral focus of aqueous ink drops onto a substrate through the implementation of electric fields for use in acoustic ink printing.

Various fluid application technologies, such as printing technologies, are being developed. One such technology uses focused acoustic energy to emit droplets of a marking material from a printhead onto a recording medium. This application is called acoustic ink printing (AIP) and is described in a number of U.S. patents, including U.S. Pat. Nos. 4,308,547, 4,697,195, 5,028,937 and 5,087,931, the disclosures of which are incorporated herein by reference.

Acoustic ink printheads typically include a plurality of droplet emitters, each of which projects a converging acoustic beam into a pool of liquid. The angular convergence of this beam is selected so that the beam comes to focus at or near the free surface of the liquid, that is, at the liquid/air interface. Printing is performed by modulating the radiation pressure that the beam of each emitter exerts against the free surface of the liquid, to selectively emit droplets of liquid from the free surface.

More particularly, modulating the radiation pressure of each beam causes the radiation pressure to make brief, controlled excursions to a sufficiently high pressure level to overcome the restraining force of the surface tension at the free surface. Individual droplets of liquid are emitted from the free surface of the pool of liquid on command, with sufficient velocity to deposit them on a nearby recording medium.

Ideally, all of the actuators in a printhead produce drops directed toward the print substrate in a direction perpendicular to the print substrate. In practice, however, some drops are not directed exactly perpendicular to the print substrate. The drops which deviate from the desired trajectory are undesirable since the misdirected drops impact the print substrate at a point not anticipated by the print controller. Therefore, misdirected drops affect the quality of the printed image by impacting the print substrate in unwanted positions.

U.S. Pat. Nos. 4,386,358 and 4,379,301 to Fischbeck, which are commonly assigned and incorporated herein by reference, disclose a method for electrostatically deflecting electrically charged ink drops emitted from an ink jet printhead. Charges placed on electrodes on the printhead disclosed by Fischbeck are controlled to steer the charged ink drops in desired directions to compensate for known printhead movement. By electrostatically steering the charged ink drops, the method disclosed in Fischbeck compensates for ink drop misdirection caused by the known printhead movement when the ink drop is emitted.

However, the electrostatic deflection method disclosed by Fischbeck does not compensate for unpredictable environmental factors which can affect ink drop trajectories. Such environmental factors include air currents and temperature gradients between the printhead and the print substrate. In acoustic ink jet printheads, unpredictable variations in the dynamics of ink drop creation also detrimentally affect ink drop trajectories. Some of the variations in ink drop creation are caused by aberrations in the lithography of Fresnel lens which are in some embodiments used to focus the acoustic wave used to create the ink drops.

U.S. patent application Ser. No. 08/480,977 entitled "Electric-Field Manipulation of Emitted Ink Drops in Printing", which is commonly assigned, and is hereby incorporated by reference, discloses the use of an electric field to reduce droplet misdirectionality, by inducing a charge on a drop as it breaks off from the bulk of the fluid. The charged drop is then accelerated into the paper, by holding the paper at a relatively large potential (this same potential may be used to induce the charge on the drop). The application teaches selectively deflecting the ink drops slightly to enhance the resolution of the image produced by a given printhead configuration. The ink jet actuators form and impart an initial velocity on the ink drops. The charged ink drops are then steered by electrodes such that the drops alternately impact upon the print medium at positions slightly offset from positions directly opposite the apertures of the printhead.

This approach, though useful, has drawbacks. It requires large voltages, of the order of 1 to 2 kV. Also, it will suffer from many of the same imaging artifacts as occur in ionographic printing, where because charge is deposited onto the printing substrate, there is print-dependent interaction of the accelerating field with the charged drop. That is, as drops are accumulated on the paper, so is their charge. If this charge is not removed quickly enough, it will produce a print-dependent potential at the paper surface, which will interfere with the acceleration of subsequent drops. Finally, the acceleration expected for drops under typical print conditions is only large enough to reduce the misplacement of drops by some 50% at the paper surface, so that the correction of the misdirection, while significant, is not complete.

U.S. patent application Ser. No. 08/721,290 entitled "Method and Apparatus for Moving Ink Drops Using an Electric Field", which is commonly assigned, and is hereby incorporated by reference, discloses using an electric field to charge and impart a force onto ink drops to control for motion of the ink drops, including biasing the print support medium with a voltage source.

SUMMARY OF THE INVENTION

The invention describes an apparatus and method to laterally focus aqueous ink drops onto a substrate, using electric fields. The drops are not charged, and focusing results from the forces on the uncharged dielectric drop that occur in non-uniform electric fields. It is shown that initial lateral velocity misdirection of the drops may be corrected using simple electric fields. Lateral velocities which would produce drop displacements of approximately 50 $\mu$m from their intended positions, at a height of 1 mm above the ink surface, may be corrected to produce displacements of less than 2.5 $\mu$m, a 20 fold decrease in print misdirectionality.

With attention to a more limited aspect of the present ejector, upper and lower wire segments are placed within an operative range of a path from an ink injector head to a paper surface within which an ink droplet will travel. The upper and lower wire segments generating an electrical field sufficient to force the ink droplet in a desired direction.

With attention to another aspect of the present invention, the wire segments are formed in fin configurations.

Yet another aspect of the present invention is that the element directing the ink droplet by producing selective electric fields is a helically formed element.

With attention to yet another aspect of the present invention, the elements imposing an electric field on the ink droplet extend substantially the full length of the droplet path. The elements are then selectively energized to generate the appropriate electrical forces.

It is therefore an object of the present invention to provide a method and device which uses electric fields to laterally focus aqueous ink drops onto a substrate. It is further desirable that the drops are not charged, and the focusing results from the forces on the uncharged dielectric drops that occur in a non-uniform electric field.

The present invention has been shown to be capable of correcting previously uncorrected drop displacements of approximately 50 $\mu$m from their intended positions, at a height of 1 mm above an ink surface, to less than 2.5 $\mu$m.

These together with other objects of the invention, along with the various features of novelty which characterize the invention, are pointed out with particularity in the claims annexed to and forming a part of this disclosure. For a better understanding of the invention, its operating advantages and the specific objects obtained by its uses, reference should be made to the accompanying drawings and descriptive matter in which there is illustrated preferred embodiments of the invention.

BRIEF DESCRIPTION OF THE DRAWINGS

The invention may take form in various components and arrangements of components, and in various steps and arrangements of steps. The drawings are only for purposes of illustrating a preferred embodiment and are not to be construed as limiting the invention.

DETAILED DESCRIPTION OF THE PREFERRED EMBODIMENT

Figure 1:
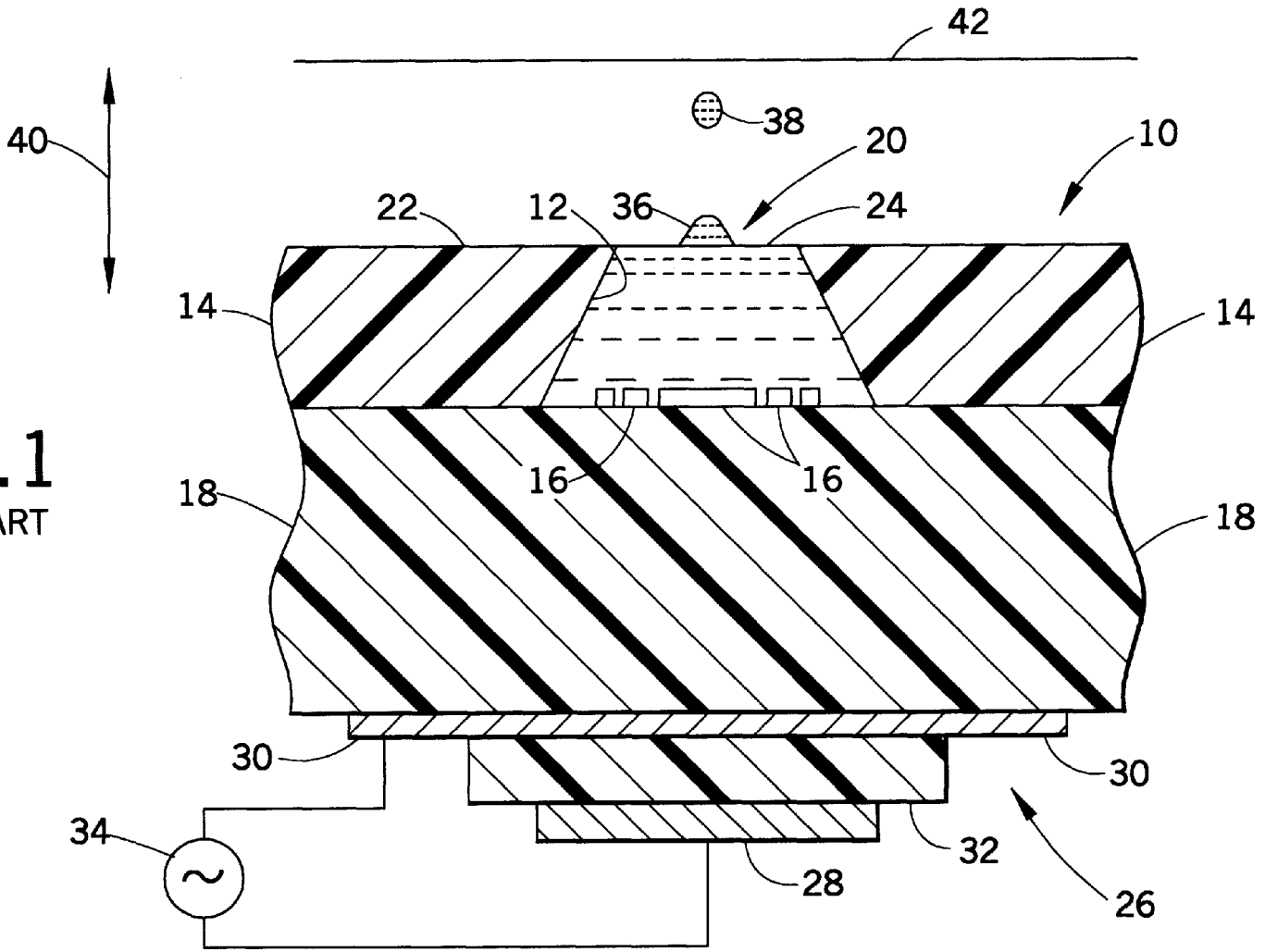
FIG. 1 PRIOR ART
FIG. 1 shows a conventional acoustic ink jet print emitter.

FIG. 1 details an acoustic ink printhead emitter 10 for acoustic ink printing (AIP). An ink channel 12 is formed in a channel forming layer 14. A Fresnel lens 16 is formed on the surface of a glass substrate 18, and channel forming layer 14 is bonded to substrate 18 such that Fresnel lens 16 is within ink channel 12. An opening 20 to ink channel 12 is formed on a top surface 22 of channel forming layer 14. During normal operation, ink fills ink channel 12 to form an ink-free surface 24 at opening 20. A piezoelectric device 26, positioned on the opposite side of substrate 18 from ink channel 12, comprises two electrodes 28 and 30 and a piezoelectric layer 32. When an radio-frequency (RF) signal from an RF source 34 is applied between electrodes 28 and 30, piezoelectric device 26 generates acoustic energy in substrate 18 directed toward ink channel 12. The Fresnel lens 16 focuses the acoustic energy entering ink channel 12 from substrate 18 onto ink-free surface 24. The ink in ink channel 12 forms an ink mound 36 in ink-free surface 24. The ink mound 36 eventually becomes an ink drop 38 moving a distance 40 toward a medium 42, such as paper. An array of the forgoing emitters 10, are used in an acoustic ink printer. It is noted that while a Fresnel lens is described, the present invention may also be implemented with acoustic ink printheads using spherical lenses.

Figure 2:
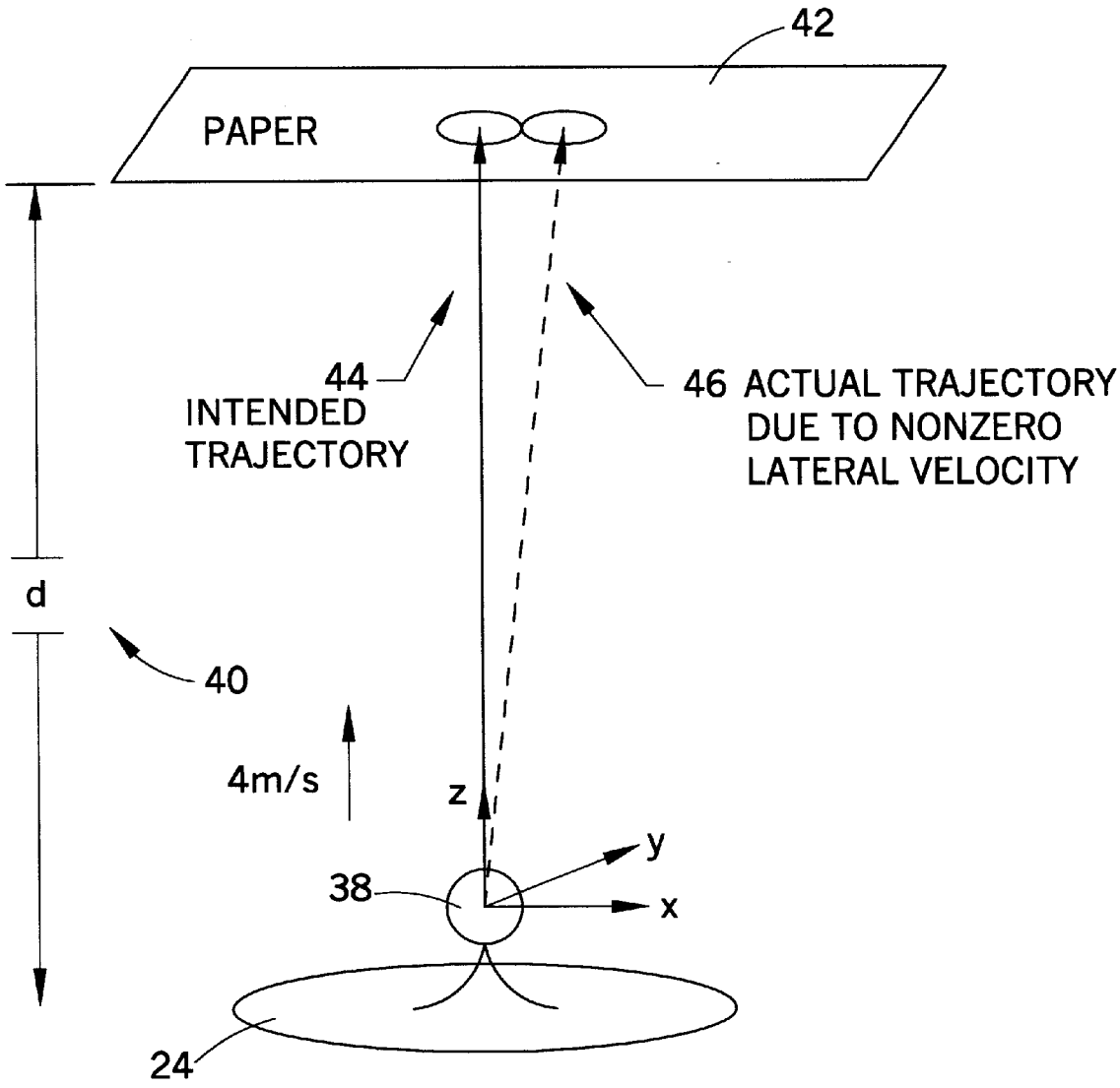
FIG. 2 is a schematic representation of lateral displacement of an ink drop.

As illustrated in FIG. 2, drops such as drop 38 are emitted from printhead emitter 10, which travel typically approximately 1 mm in a vertical direction 40 to print medium 42, usually paper. FIG. 2 illustrates that forces in the x,y,z axises act on drop 38, and any small initial lateral velocity of drop 38, as it leaves the ink surface 24, results in the drop being misplaced at the print medium 42. Typically, drops are emitted with a vertical velocity of 4 m/s, and ideally no lateral velocity, resulting in the intended trajectory 44. An initial lateral velocity of 0.2 m/s produces a lateral displacement of 50 $\mu$m at a height of d=1 mm above the fluid surface 46. Such misdirectionality may be due to a large number of causes including, static tilting of the ink surface, i.e. deformed meniscus, capillary waves on the surface of the ink, misalignment of the acoustic transducer with the lens, nonidealities in the lens or transducer, etc. Misplacement of drops on the medium may also occur if the drop is emitted at a location displaced from the middle of the acoustic lens, even if there is no lateral emission velocity. Such displacements however are rarely more than a few microns, and the great majority of objectionable drop misplacement at the paper surface is due to nonzero lateral velocity of the drop upon emission.

The present invention discloses a method and apparatus which uses electric fields to focus drops having nonzero lateral velocity onto their intended locations at paper surface 42. The method and apparatus requires applied voltages as low as tens of volts, and does not involve inducing net charge on the drops. It makes use of the high dielectric constant of aqueous inks, and the force that a dielectric feels in a nonuniform electric field.

It is well known that a dielectric will feel a net force, in a nonuniform electric field, in a direction toward the region of higher field strength, thus minimizing its electrostatic energy. For the present case of small aqueous drops, this force may be expressed as approximately:

$$F/\text{volume} = \rho a \approx \frac{1}{2}\varepsilon\nabla|E^2|, \tag{1}$$

where ρ denotes the drop density, a is its acceleration, ∈ is the dielectric constant of the drop (i.e. of water), and $E^2$ is the square of the external electric field.

Figure 3:
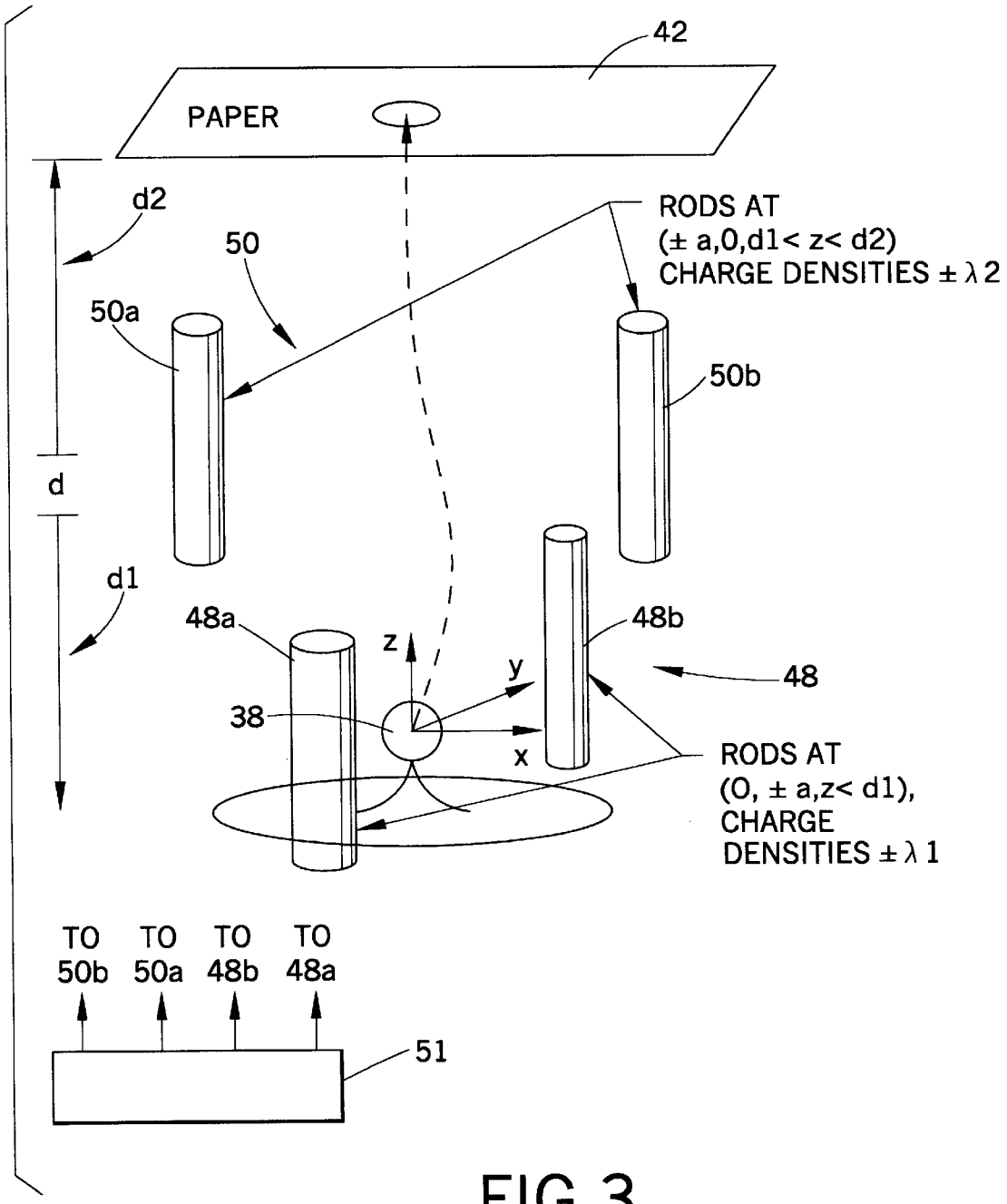
FIG. 3 is a schematic representation of a dual magnetic field used to focus an ink drop.

To focus a drop with initial nonzero lateral velocity to its desired location on the paper, it would be ideal to provide a force on the drop always toward the z-axis. This would imply however that the maximum of the electric field would be at the z-axis. In electrostatics such could only be the case if there were free charge along this axis (nonzero divergence), which is not acceptable. Instead, as shown in FIG. 3, the present inventors have considered to focus the drop 38 by using two successive dipole fields 48, 50. The first dipole field 48 focusses the drop along the x-axis, while defocusing along the y-axis. The second dipole field 50, which is orthogonal to the first, reverses the sense of the focussing. Travel of drop 38 through these fields has a net effect of focusing the trajectory to the desired location, independent of initial lateral velocity.

The geometry of the system is shown schematically in FIG. 3, which is a representation used to introduce the electric fields required for the present invention. It is to be appreciated different configurations can also be used to achieve the desired results. In FIG. 3, two wire segments 48*a*, 48*b* have charge densities ±λ1, in the region 0<z<d1. These two wires run parallel to the z-axis, and are centered at (x,y)=(0,±a). In the region d1<z<d2, two different wires 50*a*, 50*b* have charge densities ±λ2, and are centered at (x,y)=(±a,0). In the x-y plane, the wires produce dipole fields. The lower set of wires 48*a*, 48*b* produce an electric field whose magnitude increases away from the origin in the y-direction and is maximum at the origin along the x-direction. The upper two wires 50*a*, 50*b* produce an effect orthogonal to this. Thus, drop 38 is focussed in the x-direction as it moves between the lower two wires 48*a*, 48*b*, and is focussed in the y-direction as it moves between the upper two wires 50*a*, 50*b*. The electric field for lower wires 48*a*, 48*b* and upper wires 50*a*, 50*b* being generated by application of selected voltages from voltage source 51.

To present the above discussion in a more analytical manner, it can be shown that near the z-axis (x,y small), between the two lower wires 48*a*, 48*b* (i.e. at z<d1), the electrostatic force on the drop is of the form:

$$F_x \approx \frac{-2\lambda_1^2\varepsilon}{\pi^2\varepsilon_0^2a^4}x;\ F_y \approx \frac{2\lambda_1^2\varepsilon}{\pi^2\varepsilon_0^2a^4}y \tag{2a}$$

And in the region between the two upper wires 50*a*, 50*b*, (i.e. at d1<z<d2), the forces are:

$$F_x \approx \frac{2\lambda_2^2\varepsilon}{\pi^2\varepsilon_0^2a^4}x;\ F_y \approx \frac{-2\lambda_2^2\varepsilon}{\pi^2\varepsilon_0^2a^4}y \tag{2b}$$

These expressions are idealized, and correspond to fields that exist between two infinite parallel wires. They bring to light salient features of the concept that for a specific physical implementation, the appropriate forces, as a function of z, when analyzed in detail, will resemble the above relations. It is clear from Eqs. 2a, 2b that lower wire segments 48*a*, 48*b* produce instability in the y-direction. The upper wire segments 50*a*, 50*b*, conversely, provide a restoring force in the y-direction, and instability in the x-direction.

In addition to the above forces, there is a drag force on drop 38, associated with the viscosity of air. For the small drops used in acoustic ink printing, this drag force is well represented by the classic Stokes formula, where the deceleration of the drop is linearly proportional to its velocity, and inversely proportional to a characteristic time parameter, which for water takes the value $1.2\times10^7 r^2\gamma$=seconds where r is the drop radius, in meters.

In consideration of the above, the equations showing the motion for the ink drop may be obtained. Assume that drop 38 leaves fluid surface 24 at the location (x,y,z)=(0,0,0), at time t=0.

Drop 38 has initial velocities, vx0, vy0, and vz0. Typically, vz0=4 m/s. We will define the time t1 and time t2 to be those at which the drop reaches heights z=d1 and z=d2, respectively, and the drop 38 reaches the paper surface z=d (typically $10^{-3}$ m) at time t3. The equations of motion are then determined to be:

$$0 < t < t_1 : \frac{d^2x}{dt^2} + \frac{1}{\tau}\frac{dx}{dt} + \gamma_1 x = 0 \tag{3a}$$

$$\frac{d^2y}{dt^2} + \frac{1}{\tau}\frac{dy}{dt} - \gamma_1 y = 0;\ \frac{d^2z}{dt^2} + \frac{1}{\tau}\frac{dz}{dt} = 0$$

$$t_1 < t < t_2 : \frac{d^2x}{dt^2} + \frac{1}{\tau}\frac{dx}{dt} - \gamma_2 x = 0 \tag{3b}$$

$$\frac{d^2y}{dt^2} + \frac{1}{\tau}\frac{dy}{dt} + \gamma_2 y = 0;\ \frac{d^2z}{dt^2} + \frac{1}{\tau}\frac{dz}{dt} = 0$$

$$t_2 < t < t_3 : \frac{d^2x}{dt^2} + \frac{1}{\tau}\frac{dx}{dt} = 0 \tag{3c}$$

$$\frac{d^2y}{dt^2} + \frac{1}{\tau}\frac{dy}{dt} = 0;\ \frac{d^2z}{dt^2} + \frac{1}{\tau}\frac{dz}{dt} = 0$$

where, $$\gamma_1 = \frac{2\lambda_1^2\varepsilon}{\pi^2\varepsilon_0^2a^4\rho};\ \gamma_2 = \frac{-2\lambda_2^2\varepsilon}{\pi^2\varepsilon_0^2a^4\rho} \tag{4}$$

Figure 4:
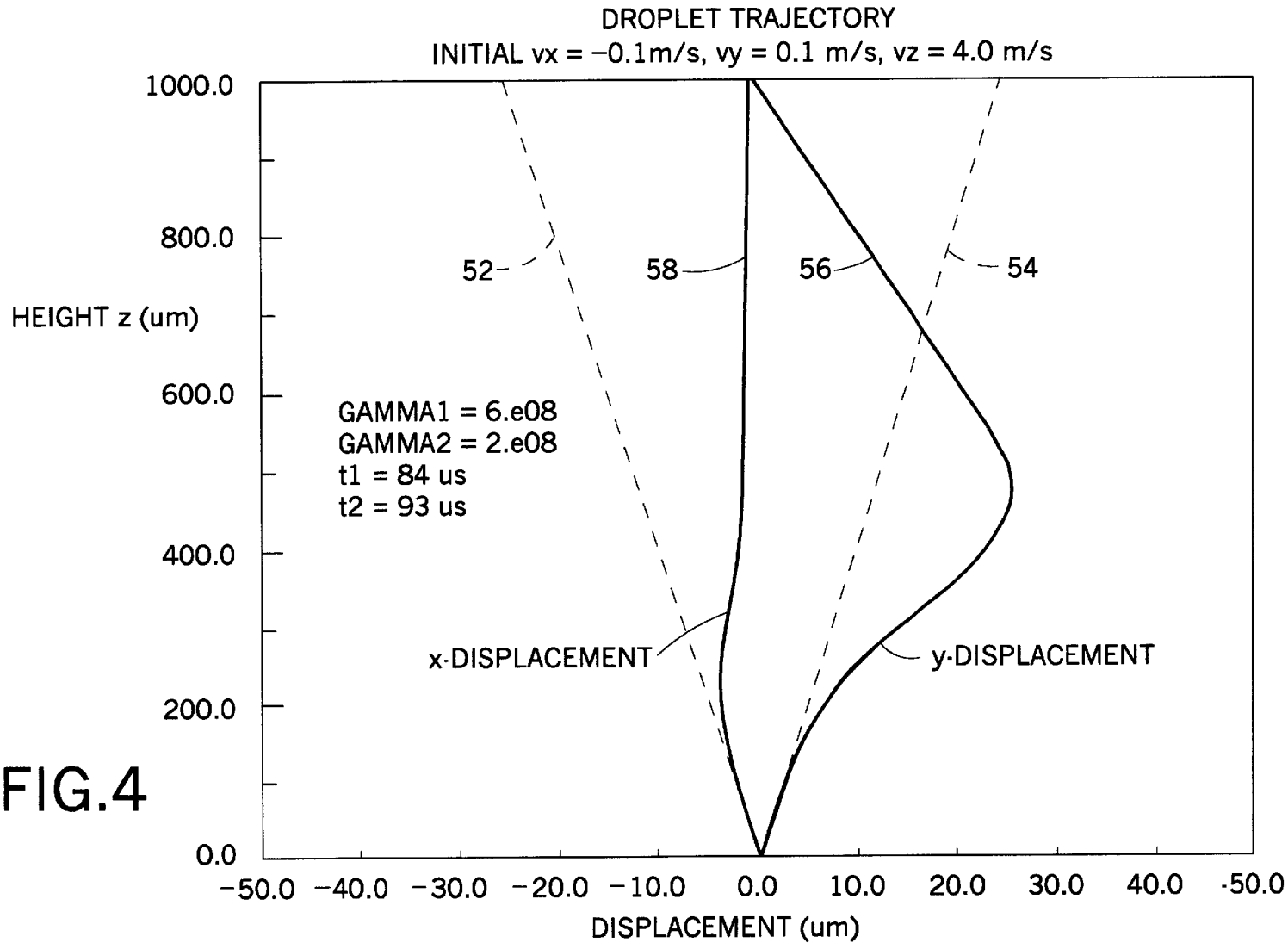
FIG. 4 provides a graphical representation of droplet trajectory with and without the concepts of the present invention applied.

These equations may be integrated directly for given values of λ1, λ2, t1, and t2. The mathematics for such integration is well known and therefore will not be set forth below. In Eq. 4, γ represents a generally normalized charge density of two wires, i.e. normalized charge density $\gamma_1$ and $\gamma_2$. Of importance is that for selected values of the above four parameters, drops of initial arbitrary lateral velocity vx0 and vy0, can be made to have trajectories that end very near the desired location (x,y,z)=(0,0,d). A typical trajectory is shown in FIG. 4. Here the x-displacement and y-displacement of drop 38 are shown as a function of height z. The initial velocity vector of the drop is (vx0, vy0, vz0)=(−0.1 m/s, 0.1 m/s, 4.0 m/s). The dotted lines 52, 54 indicate the uncorrected trajectory, while the solid lines 56, 58 show the trajectory in the presence of the electric fields generated by 48, 50 of FIG. 3. The values of γ1 and γ2 are respectively $6.0\times10^8$ $s^{-2}$ and $2.0\times10^8$ $s^{-2}$. The values of t1 and t2 are 84 μs and 93 μs, respectively. The drop radius is taken to be r=5.2 μm, as it is throughout this discussion.

Figure 5:
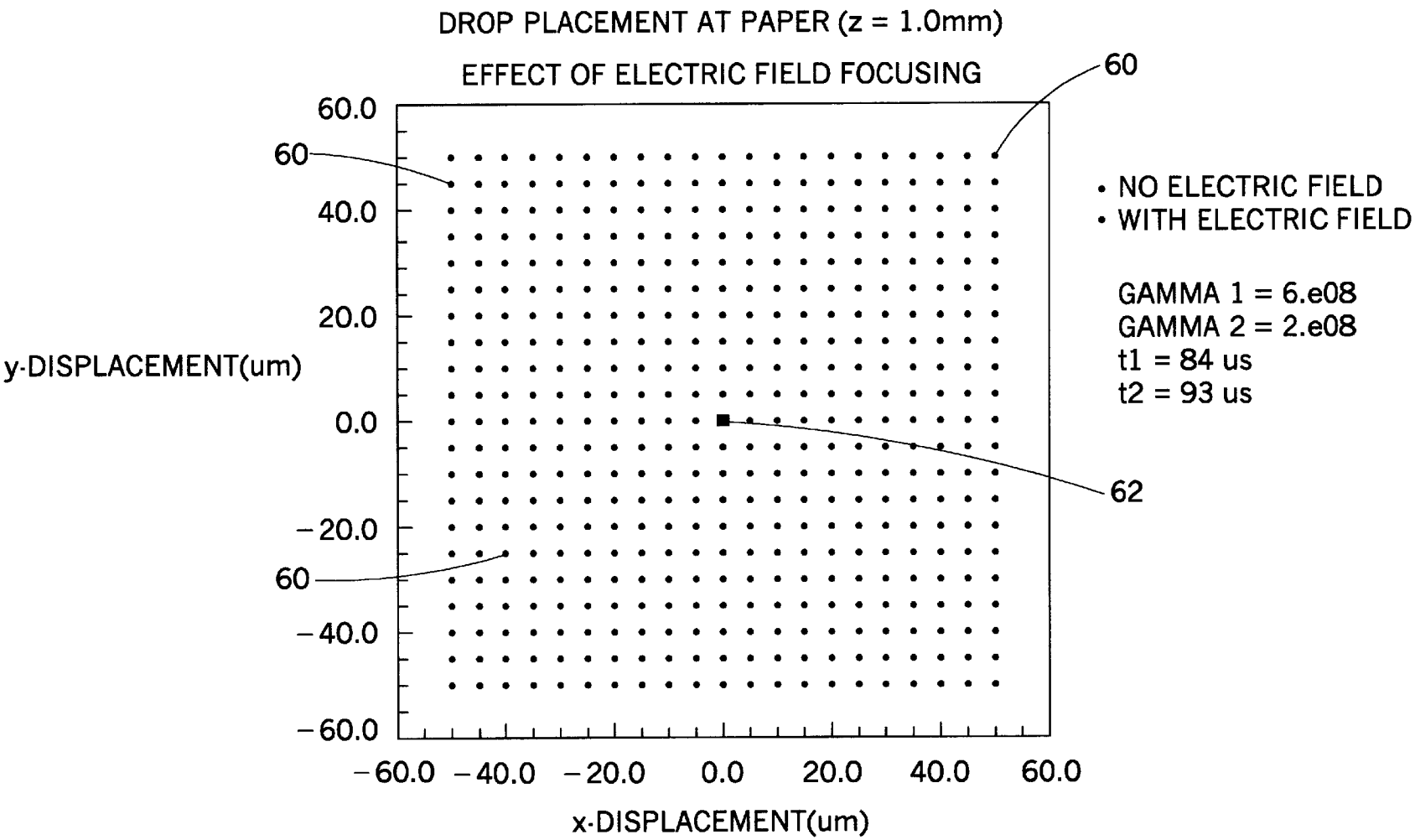
FIG. 5 illustrates the intersections of trajectories of drop displacement at a paper surface illustrating the effect of the electric field focusing.

FIG. 5 illustrates the intersections of trajectories with the plane z=d=1 mm, for initial lateral velocities in the range −0.2 m/s<vx0, vy0<0.2 m/s. The parameters γ1, γ2, t1, and t2 are those given above. Dots 60 show the intersection of ink drops and paper where no electric field is present. Here the drops move in a straight line to the paper (i.e the plane z=d), with lateral displacement in the range −50 μm<x,y<50 μm. With the electric fields present, these trajectories are focused into the set of dots 62, in the range −1.5 μm<x,y<1.5 μm. This represents a roughly 30-fold decrease in the lateral misplacement of the drop at the paper surface. Dots 60 are all those other than designated as 62. It is to be appreciated that for a printer of 600spi this is equal to an area of approximately 42.3 μm. The present invention can also be used with printers having other spots per inch values.

Figure 6:
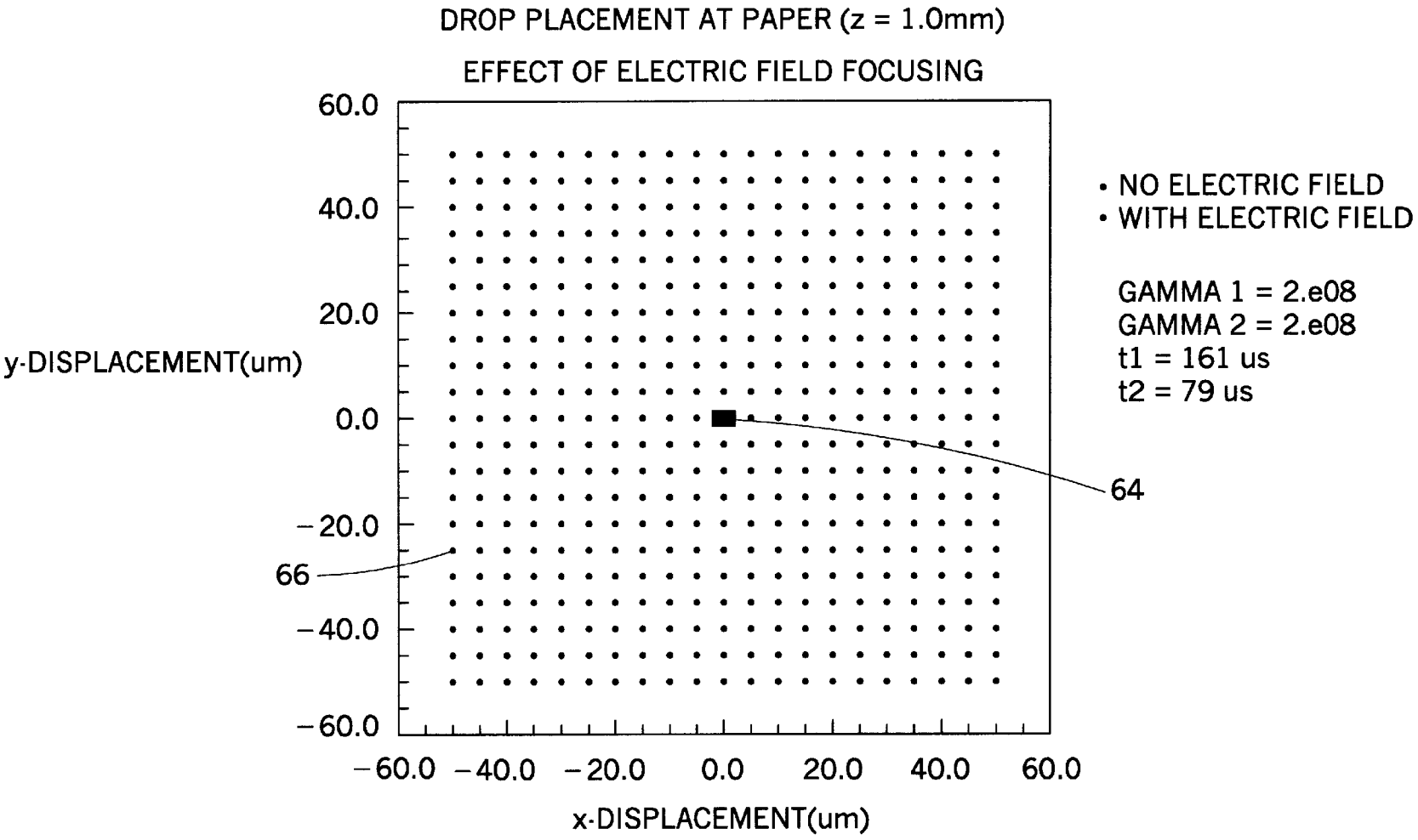
FIG. 6 provides a further illustration of drop displacement at a paper surface with or without electric field focusing.

FIG. 6 details similar results for a slightly different set of parameters: γ1=2.0e08$s^{-2}$, γ2=2.0e08$s^{-2}$, t1=161 μs, and t2=79 μs. The dots 64 representing a ink drop with a corrected trajectory and remaining dots 66, representing ink drops with uncorrected trajectories. It is to be noted that there are various combinations of parameters which produce improved focusing, and it will be desirable to choose a specific set depending upon the physical restrictions of a given printhead geometry. Dots 64 are all those other than designated as 66.

The above parameter values may readily be interpreted in terms of more physical quantities. First, the parameter γ may be associated with voltages ±V on a pair of parallel wires. The wires are then taken to have a radius b, and to be separated by a distance 2*a*.

The capacitance per unit length of the wires is $C=2\pi\in_0/\cosh^{-2}(2a^2-b^2)/b^2$. It therefore follows that:

$$V_{1,2} = a^2\left(\frac{\rho\gamma_{1,2}}{8\varepsilon}\right)^{\frac{1}{2}}\cosh^{-1}\left[\frac{2a^2}{b^2}-1\right] \tag{5}$$

For water, $\rho=1000$ kg/m$^3$, and $\in=7\times10^{-10}$ farad/m. If a=50 $\mu$m, and b=5 $\mu$m, it can be calculated that $V_{1,2}=0.0063$ sqrt $(\gamma_{2,1})$. For $\gamma=2.\times10^8 s^{-2}$, the corresponding voltage is 89V. For $\gamma=6\times10^8 s^{-2}$, the voltage is 154V.

It is to be appreciated that the physical length of the wire segments is related directly to the transit times t1 and t2. It is easily shown that d1=vz0$\tau$[1−exp(−t1/$\tau$)], and that (dz−d1)=vz0$\tau$exp(−t1/$\tau$)[1−exp(−t2/$\tau$)]. For the case of t1=84 $\mu$s and t2=93 $\mu$s, the corresponding wire segment lengths are d1=91 $\mu$m and (d2−d1)=77 $\mu$m. Here it is assumed that there is an initial velocity vz0=4 m/s, and a characteristic viscous drag time of t=325 $\mu$s. Similarly, for the case of t1=161 $\mu$s, and t2=79 $\mu$s, the corresponding wire segment lengths are d1=156 $\mu$m and (d2−d1)=53 $\mu$m.

From the above values for voltage and wire segment length, it is shown that the voltages of the order of 100V are needed, with structures of the order of 100 $\mu$m in length. Such values are quite easy to realize in practice. It might be convenient however to reduce the necessary voltage level. This can be achieved by decreasing the distance 2*a* between the wires. Note that a decrease by 30% would reduce the voltage by a factor of two.

Figure 7A:
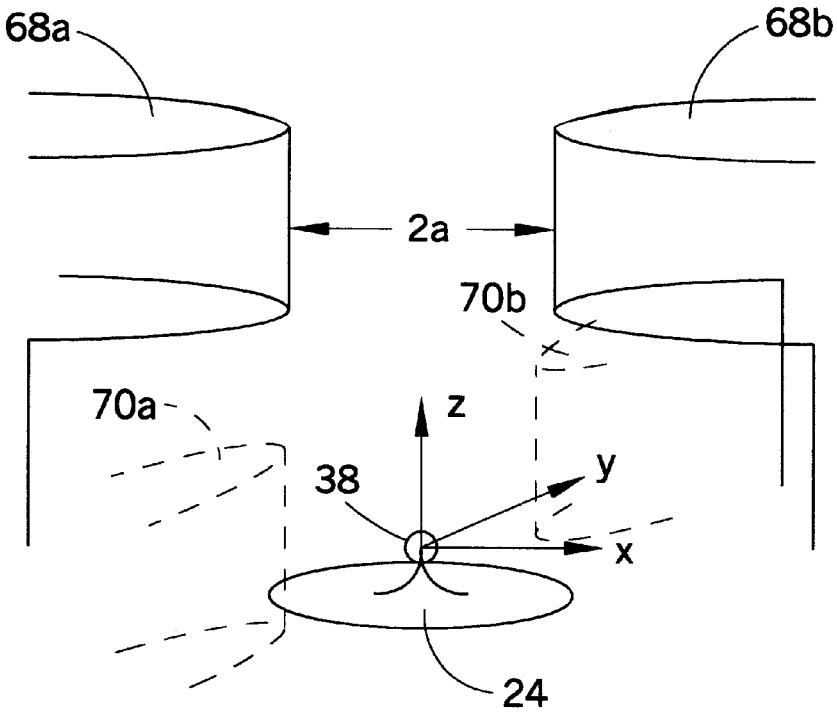
FIG. 7*a* illustrates a first structure to produce appropriate electrical fields for the teachings of the present invention.
Figure 7B:
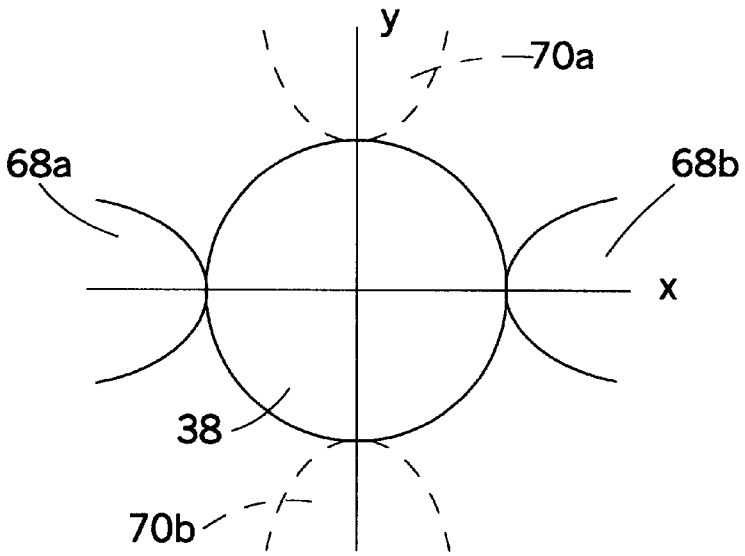
FIG. 7*b* illustrates a top view of FIG. 7*a;*
Figure 8:
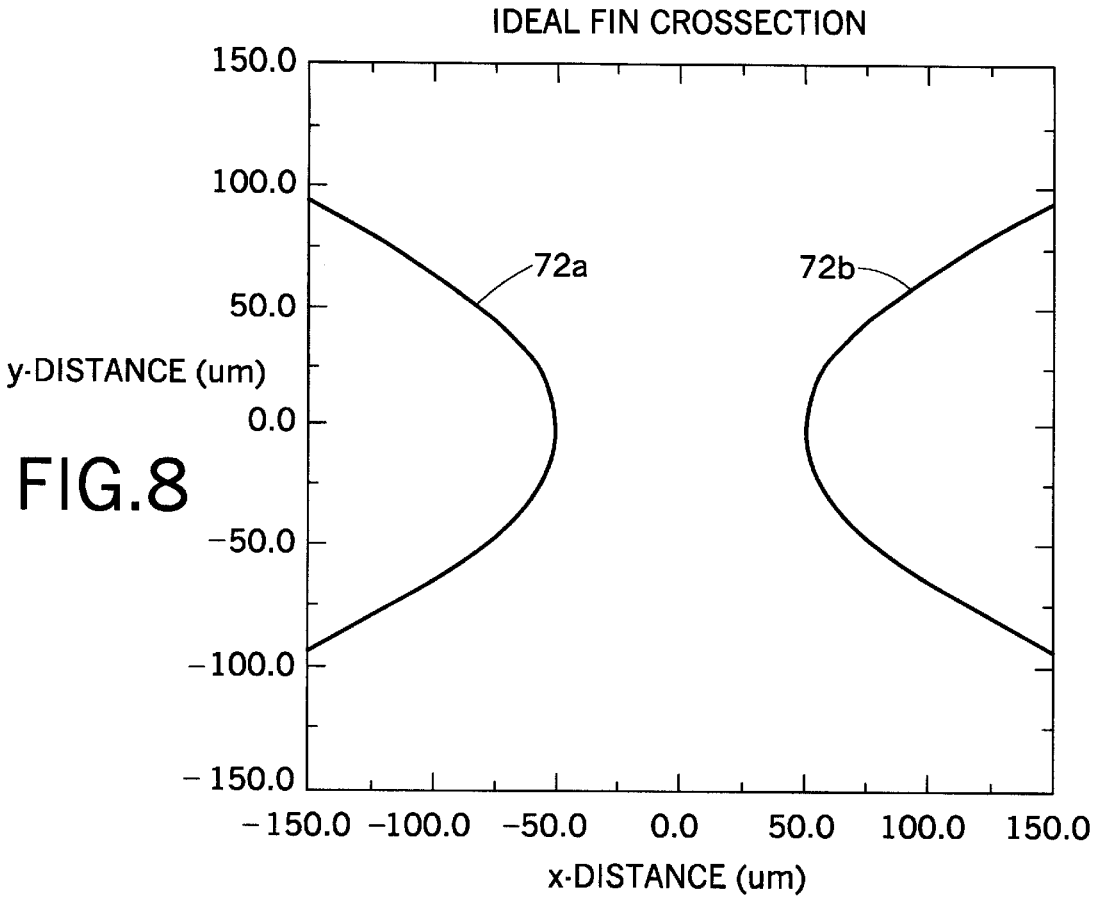
FIG. 8 details a cross-sectional view of a pair of fins used in connection with the present invention.

Of course, the model of parallel wires has only been used to simplify the analysis. In practical devices, a structure needs to be fabricated that is consistent with existing plating and micro-machining technology. Many structures can be developed to produce the appropriate electrical fields. One such structure is illustrated in FIG. 7*a*. Here the wires are fabricated as upper fins 68*a*, 68*b* and lower fins 70*a*, 70*b*, whose cross section is indicated in FIG. 7*b*. It is valuable to note that there is in fact an ideal fin shape, which could readily be made by existing plating or micro machining techniques. This fin shape will produce exactly the desired field in the region between the fins, with minimum voltage applied to the fins. The shape is determined by selecting the voltage:

$$V = \frac{1}{a}\left(\frac{\rho\gamma}{2\varepsilon}\right)^{\frac{1}{2}}x\left(a^2+\frac{1}{3}x^2-y^2\right), \tag{6}$$

to exist between the fins (this voltage produces exactly the fields that have been modeled to generate drop focussing). To produce the desired voltage, a fin is constructed with the appropriate profile to satisfy the voltage condition along its surface. The cross sectional shape of such a pair of fins 72*a*, 72*b* is shown in FIG. 8, for the case where a=50 $\mu$m. It may be noted that for these fin shapes, the voltage needed to produce a value of $y=2.\times10^8 s^{-2}$ is only 40V. Thus, by tailoring the shape of the structure that produces the desired electric field, the required voltages to produce drop focusing are reduced by a factor of two.

Figure 9:
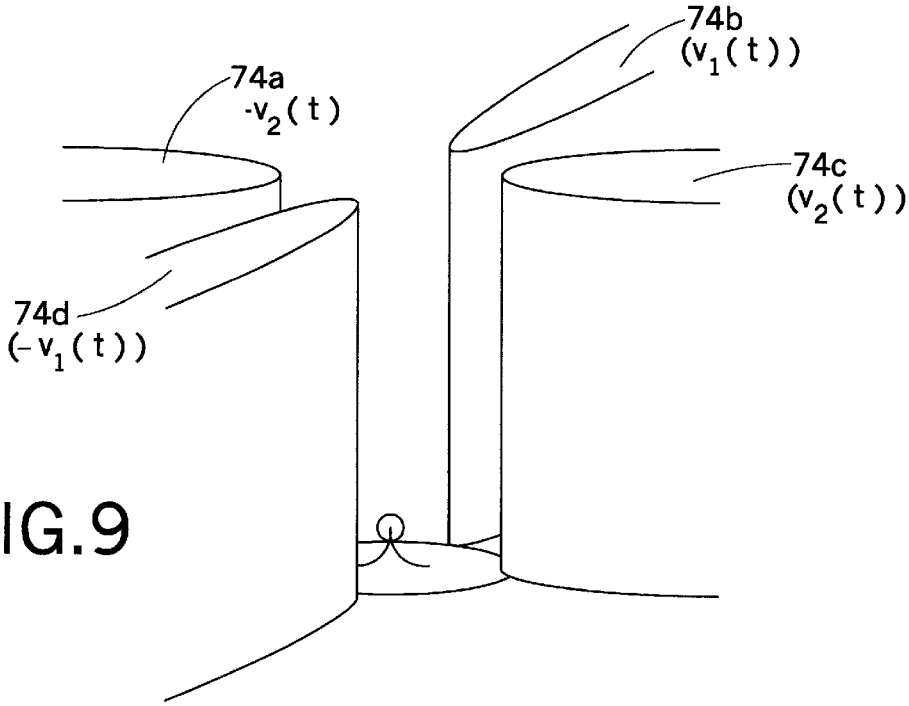
FIG. 9 shows an additional embodiment of an arrangement for the teachings of the present invention.

In FIGS. 7*a*–7*b*, the lower fins 70*a*, 70*b* (0<z<d1) are made to end at z=d1, while the upper fins 68*a*, 68*b* are recessed below the height z=d1. Another approach to producing the desired fields would be to have each of the fins 74*a*–74*d* present, as described in FIG. 9, over the entire region 0<z<d1+d2. Now, the appropriate fields are produced by applying the voltages temporally, at the appropriate time. Thus for time 0<t<t1 the voltage V1 would be applied to one pair of fins 74*b*, 74*d*, while for time t1<t<t1+t2, the voltage V2 would be applied to the orthogonal pair of fins 74*a*, 74*c*. This approach allows a simple mechanical structure, at the cost of some complexity in driving the voltages, since they must be synchronized to the drop formation. The fin structure may be built on the existing aperture plate, or may be incorporated into the aperture shape itself.

As an alternative embodiment, a single pair of helical fins may be used to produce ink droplet focusing as well. It should be understood the preceding describes the use of electric fields to reduce misdirectionality, due to the force on the dielectric drop in an electric field gradient. A number of structural embodiments may exist beyond those described here, for example, it is certainly possible to have more than two stages of alternating electrode fields along the trajectory of the drop.

It is also valuable to note that because the electrostatic force on the dielectric drop is a function of the field magnitude, the pairs of wires or fins may be driven with a high-frequency AC voltage power supply (i.e. at a frequency much larger than 1/t1, 1/t2). This is important if there is inadvertently any net charge on the drop, for example as a result of its formation process. A net charge would otherwise introduce forces not included into the above analysis, most likely causing defocusing of the drop trajectories. The AC field would cause these forces to have a time-averaged value of zero. In addition, use of an AC voltage might be advantageous in minimizing electrochemical degradation of the structures over time. It is to be appreciated that while primarily described in conjunction with AIP, the present invention can be used in other embodiments including the generation of a textured material and the generation on metal drops.

Therefore, the foregoing is considered as illustrative only of the principles of the invention. Further, since numerous modifications and changes will readily occur to those skilled in the art, it is not desired to limit the invention to the exact construction and operation shown and described and accordingly, all suitable modifications and equivalence may be resorted to falling within the scope of the invention.

Having thus described the present invention I now claim:

1. An acoustic printhead for emitting drops of liquid on demand from a free surface of a dielectric liquid pool, comprising:

a solid substrate having first and second surfaces, said first surface having an ink channel formed therein for containing the liquid pool, and said second surface having an acoustic focussing element formed therein;

acoustic wave generating means coupled to the second surface of the substrate for generating acoustic waves to the acoustic focussing element such that the acoustic focussing element launches converging acoustic beams into the liquid pool thereby causing an uncharged dielectric drop to be formed and emitted from an origin at the liquid pool and traveling a distance along a path to a desired destination; and at least a first and a second drop path altering means for altering the path of the drop, wherein said first drop path altering means generates a first dipole field along a first region of the distance traveled by the uncharged drop, and said second drop path altering means generates a second dipole field along a second region of the distance traveled by the uncharged drop.

2. The acoustic printhead according to claim 1 further including:

a power supply configured to supply voltage to each of the first drop path altering means and the second drop path altering means, wherein the first dipole field provides a net effect of focussing a trajectory along a first dimension and the second dipole field providing a net effect of focussing a trajectory along a second dimension, orthogonal to said first dimension, of the uncharged dielectric drop traveling to the desired destination, independent of an initial nonzero lateral velocity of the uncharged dielectric drop.

3. The acoustic printhead according to claim 2 wherein the first dipole field is generated with a first set of wire segments and the second dipole field is generated with a second set of wire segments.

4. The acoustic printhead according to claim 2 wherein the power supply supplies a high-frequency AC voltage to the first and second dipole fields.

5. The acoustic printhead according to claim 2 wherein the drop path altering means produces drop displacements at a medium receiving the drop at less than 2.5 $\mu$m.

6. An apparatus for altering the path of an uncharged dielectric drop having a nonzero lateral velocity, the uncharged dielectric drop traveling a distance from an origin to a destination in substantially a z-axis of a three dimensional xyz axis space, the uncharged dielectric drop being emitted from a drop emitting device, the apparatus comprising:

a first dipole field located within an operational position to the path of the uncharged dielectric drop, wherein the first dipole field focuses the uncharged dielectric drop along the x-axis for a selected portion of the distance the uncharged dielectric drop travels from the origin to the destination;

a second dipole field located within an operational position to the path of the uncharged dielectric drops, wherein the second dipole field focuses the uncharged dielectric drop along the y-axis for a selected portion of the distance the uncharged dielectric drop travels from the origin to the destination; and a power supply configured to supply voltage to each of the first dipole field and the second dipole field, wherein the first dipole field and the second dipole field provide a net effect of focussing a trajectory path of the uncharged dielectric drop to the desired destination, independent of an initial nonzero lateral velocity.

7. The apparatus according to claim 6 wherein the first and second dipole fields are generated by two sets of wire segments located in a region d, wherein d defines the distance from the origin to the destination traveled by the drop in the z axis, the first set of wire segments located in an area defined as d1 of d and the second set of wire segments, orthogonal to the first set of wire segments, located in an area defined as d2 of d, wherein d1 and d2 are non-overlapping regions of d.

8. The apparatus according to claim 7 wherein the two sets of wire segments are configured in the form of fins.

9. The apparatus according to claim 8 wherein the shape of each of the fins are formed such that the voltage is, $$V = \frac{1}{a}\left(\frac{\rho\gamma}{2\epsilon}\right)^{\frac{1}{2}}\left(a^2 + \frac{1}{3}x^2 - y^2\right),$$

and exists between the fins, wherein a is the acceleration of the uncharged dielectric drop, ρ denotes the density of the uncharged dielectric drop, γ is a normalized charge density of the wire used to form the fins, ∈ is the dielectric constant of the uncharged drop, and x, y represent dimensional values along the x, y axes.

10. The apparatus according to claim 9 wherein the fins are arranged as at least two lower fins in the area d1 and at least two upper fins in the area d2.

11. The apparatus according to claim 10 wherein the fins are driven by a high-frequency AC voltage power supply.

12. The apparatus according to claim 11 wherein the high-frequency AC voltage is substantially greater that 1/t1, 1/t2, wherein t1 is a time the uncharged dielectric drop is within the area d1, and t2 is a time the uncharged dielectric drop is within the area d2.

13. The apparatus according to claim 12 wherein the lower fins are made to end at z=d1 while the upper fins are recessed below the height z=d2.

14. The apparatus according to claim 8 wherein each of the fins are present over the entire region, 0<z<d1+d2, and wherein the power supply is configured to supply voltage to the fins in a temporally selective manner.

15. The apparatus according to claim 7 wherein the drop displacement at a medium receiving the uncharged dielectric drop is less than 2.5 $\mu$m.

16. A method for altering a path of an uncharged dielectric drop having an initial nonzero lateral velocity, the drop traveling a distance from an origin to a destination in substantially a z axis of a xyz axis space, the drop being emitted from a drop emitting device, the method comprising:

generating a first dipole field within a first selected region of the path of the uncharged dielectric drop;

applying the first dipole field to the drop to thereby focus the uncharged dielectric drop along the x-axis;

generating a second dipole field within a second selected region of the path of the uncharged dielectric drop which is orthogonal to the first dipole field; and applying the second dipole field to the uncharged dielectric drop to thereby focus the uncharged dielectric drop along the y-axis, reversing the sense of the focussing of the first dipole field, wherein travel of the uncharged dielectric drop through the first and second dipole fields has a net effect of focussing a trajectory of the uncharged dielectric drop such that the uncharged dielectric drop is directed to a desired destination, independent of the initial nonzero lateral velocity.

17. The method according to claim 16 wherein the distance from the origin to the destination is defined as d, the first dipole field is applied to the drop in a sub-region of d defined as d1, and the second dipole field is applied to the drop in a sub-region d defined as d2, and d1<d2.

18. The method according to claim 17 wherein the step of generating the first and second dipole fields include supplying selected voltages to first and second sets of wire segments, the first set of wire segments arranged to be operational in the path of the drop along d1, and the second set of wires arranged to be operational in the path of the drop along d2.

19. The method according to claim 18 further including the step of generating the first and second dipole fields by fin type configurations.

20. The method according to claim 18 wherein the first and second dipole fields are generated by a high-frequency AC voltage.

* * * * *